US008092748B2

(12) United States Patent
Forster et al.

(10) Patent No.: US 8,092,748 B2
(45) Date of Patent: Jan. 10, 2012

(54) HOUSING FOR A COMPONENT OF AN EXHAUST SYSTEM AND METHOD OF PRODUCING SUCH A HOUSING

(75) Inventors: Erich Forster, Grossaitingen (DE); Stefan Keller, Meitingen (DE); Otto Steinhauser, Neusaess (DE)

(73) Assignee: EMCON Technologies Germany (Augsburg) GmbH, Augsburg (DE)

( * ) Notice: Subject to any disclaimer, the term of this patent is extended or adjusted under 35 U.S.C. 154(b) by 865 days.

(21) Appl. No.: 12/066,514

(22) PCT Filed: Sep. 6, 2006

(86) PCT No.: PCT/EP2006/008683

§ 371 (c)(1),
(2), (4) Date: May 16, 2008

(87) PCT Pub. No.: WO2007/036286

PCT Pub. Date: Apr. 5, 2007

(65) Prior Publication Data

US 2009/0022634 A1 Jan. 22, 2009

(30) Foreign Application Priority Data

Sep. 23, 2005 (DE) ..... 10 2005 045 535

(51) Int. Cl.
*B01D 50/00* (2006.01)
*B21D 51/16* (2006.01)

(52) U.S. Cl. ..... 422/177; 422/179; 422/180; 29/890; 60/299

(58) Field of Classification Search ..... 422/171, 422/179, 180, 177; 29/890, 509, 446, 455.1; 60/299

See application file for complete search history.

(56) References Cited

U.S. PATENT DOCUMENTS

| | | | | | |
|---|---|---|---|---|---|
| 4,155,980 | A * | 5/1979 | Santiago et al. | ..... | 422/180 |
| 4,347,219 | A | 8/1982 | Noritake | | |
| 4,437,219 | A * | 3/1984 | Dore | ..... | 29/283 |
| 5,118,476 | A | 6/1992 | Dryer | | |
| 5,829,132 | A * | 11/1998 | Sickels et al. | ..... | 29/890 |
| 6,128,821 | A * | 10/2000 | Grescher | ..... | 29/890 |
| 7,032,312 | B2 * | 4/2006 | Burnette et al. | ..... | 29/890 |
| 7,662,204 | B2 * | 2/2010 | Forster et al. | ..... | 55/523 |

FOREIGN PATENT DOCUMENTS

| | | | |
|---|---|---|---|
| EP | 0982480 | | 3/2000 |
| EP | 1548243 | | 6/2005 |
| WO | WO 2006/015730 | * | 2/2006 |

OTHER PUBLICATIONS

Search Report, PCT 210 completed by EPO Nov. 24, 2006.

* cited by examiner

*Primary Examiner* — Nina Bhat
(74) *Attorney, Agent, or Firm* — Carlson, Gaskey & Olds

(57) ABSTRACT

A housing for a component of an exhaust system, in particular for an exhaust gas purification device, has an envelope that comprises a shrunk clamping portion for the component, a transition portion that adjoins the clamping portion in an axial direction, and a connecting portion that adjoins the transition portion in the axial direction. The diameter of the connecting portion is larger than that of the clamping portion. A method of producing the housing for the component includes providing a tubular envelope, and inserting the component into the envelope. A shrinking step is then carried out in the clamping portion which terminates spaced apart from ends of the envelope as viewed in the axial direction, whereas the axial ends of the envelope are not acted upon.

16 Claims, 3 Drawing Sheets

HOUSING FOR A COMPONENT OF AN EXHAUST SYSTEM AND METHOD OF PRODUCING SUCH A HOUSING

RELATED APPLICATIONS

This application claims benefit under 35 USC 371 of PCT/EP2006/008683 filed Sep. 6, 2006.

The application claims priority to DE 10 2005 045 535.2, which was filed Sep. 23, 2005.

BACKGROUND OF THE INVENTION

The invention relates to a housing for a component of an exhaust system, in particular for an exhaust gas purification device. The invention also relates to a method of producing a housing for a component of an exhaust system.

The component can be in particular a diesel particulate filter or a catalyst. These are mounted within the housing along with a support mat. Most recently, a manufacturing method referred to as "calibration," has often been used for such a housing. In this method, the housing is provided to have an envelope, which is closed in a circumferential direction. The component is then pushed into the envelope along with the support mat, and the envelope is then upset in a radial direction until the component, along with the support mat, is retained within the housing with a desired pressure. This method is also known as a "shrinking process." In modern shrinking methods, an envelope is shrunk individually, which means that the individual dimensions of the component and of the support mat are taken into account. This results in the diameter of the shrunken housing varying within determined limits.

To permit the coupling of the housing, along with the component inserted therein, to an exhaust system, an inlet cone and an outlet cone are usually mounted upstream and downstream of the housing. Since these are always made available with the same diameter, it is provided in modern shrinking methods to calibrate axial ends of the housing for the component after the shrinking step such that independently of the individual shrinking, the housing always has the same diameter at least at the axial ends. This method can be expensive.

The object of the invention is to provide a housing for a component of an exhaust system, which permits the coupling of an inlet cone or of an outlet cone with low effort. The object of the invention also includes providing a method for a simplified manufacturing of such a housing.

SUMMARY OF THE INVENTION

For this purpose, provision is made according to the invention for a housing for a component of an exhaust system, in particular for an exhaust gas purification device. The housing has an envelope that comprises a shrunk clamping portion for the component, a transition portion that adjoins the clamping portion in an axial direction, and a connecting portion that adjoins the transition portion in the axial direction. The diameter of the connecting portion is larger than that of the clamping portion.

The following steps are provided in one example of a method according to the invention. A tubular envelope is at first provided. The component, along with the support mat, is then inserted into the envelope. The envelope is then shrunk in a clamping portion, which terminates spaced apart from ends of the envelope as viewed in the axial direction. The axial ends of the envelope are not acted upon. The invention is based on the surprising finding that if the envelope is shrunk only in a central region, and a short portion at the axial ends of the envelope remains unworked, the diameter and also the angle of these unworked portions depend only to a very low degree on the diameter of the shrunk central region. In other words, an approximately truncated connecting portion is always produced at the axial ends of the envelope independently of the diameter to which the central region is shrunk. The diameter and the angular orientation of this connecting portion varies only to a small extent such that it is suitable for the coupling of an inlet cone or of an outlet cone without further working steps.

According to one example embodiment of the invention, the envelope terminates approximately flush with the component in the axial direction when the latter is received within the housing. This constitutes a particular advantage of the method according to the invention and of the housing according to the invention, since it is possible to configure the envelope shorter than in the prior art. In the prior art, the envelope must project beyond the component in the axial direction, since otherwise, the calibration of the axial ends of the envelope is impossible. The invention however takes the finding into account that the diameter of the envelope increases at the axial ends when the clamping portion is shrunk, so that enough space is available for receiving the inlet cone or the outlet cone. This is surprising because the change in the diameter at the axial end of the envelope is exactly opposite to that of the diameter of the clamping portion.

BRIEF DESCRIPTION OF THE DRAWINGS

The invention is described below with reference to one embodiment which is illustrated in the enclosed drawings, in which.

DETAILED DESCRIPTION OF THE PREFERRED EMBODIMENT

Figure 1:
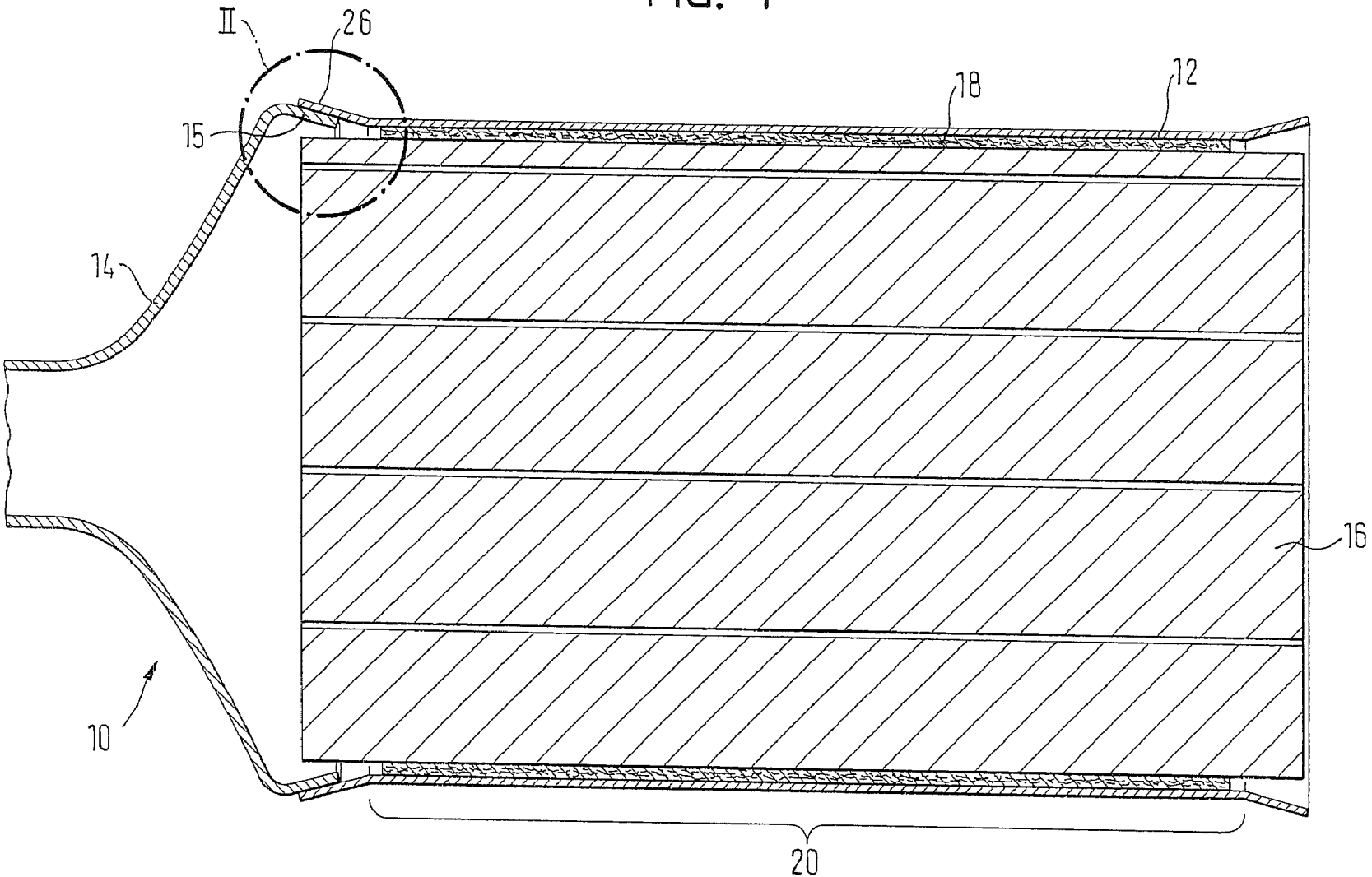
FIG. 1 shows a schematic section of a housing according to the invention.

FIG. 1 shows a housing 10 which consists of an envelope 12 and of two coupling parts 14, only one of them being shown in the present case. The coupling parts 14 are an inlet cone or an outlet cone that allow the housing 10 to be coupled to an exhaust system of a combustion engine. A component 16 of the exhaust system, in particular a diesel particulate filter or a catalyst, is arranged within the housing 10. The component 16 is surrounded by a support mat 18.

Figure 3:
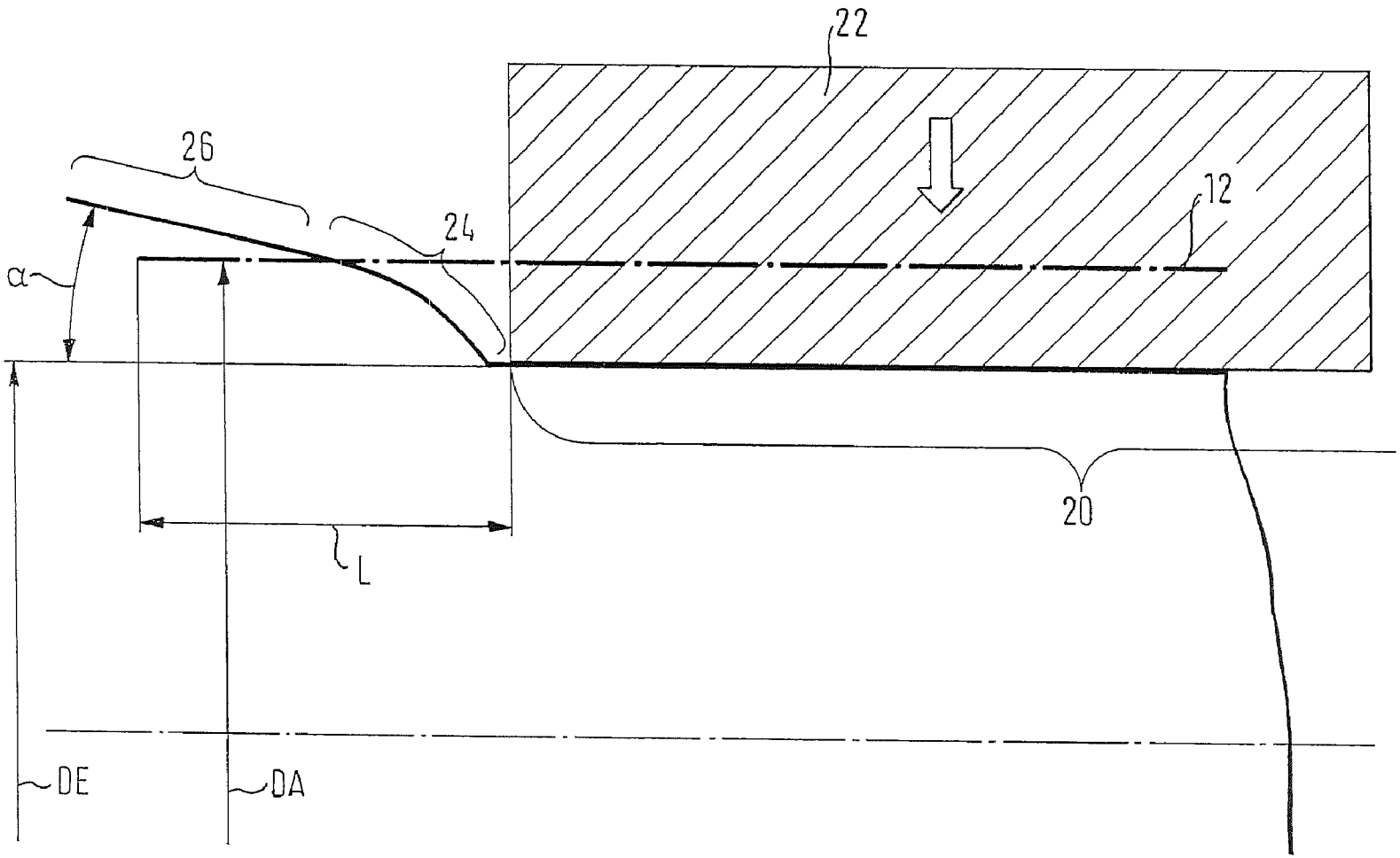
FIG. 3 schematically shows the shape of an envelope before and after the shrinking process.

In an initial state, i.e. before mounting of a component 16, an envelope 12 has a diameter DA (see FIG. 3). The envelope 12 need not necessarily have a circular cross-section but may have an oval, a tri-oval or other cross-section. In the initial state, a length L of the envelope 12 projects beyond a clamping portion 20 in which a shrinking tool 22 engages the envelope 12 and upsets the latter in a radial direction, as can also be seen in FIG. 3. As a result of the upsetting of the envelope 12 in the region of the clamping portion 20, the diameter at this location is reduced to the end diameter DE (see FIG. 3) so that the component 16 is firmly retained within the envelope 12 along with a support mat 18. During the upsetting or shrinking step, the region of the envelope 12, which projects beyond the shrinking tool 22 in the axial direction is deformed in the way shown in FIG. 3. A transition portion 24, which has an arcuate cross-section and in which the diameter of the envelope 12 is outwardly enlarged, adjoins the radially inwardly upset clamping portion 20. A connecting portion 26, which is approximately truncated and has a maximum diameter at an axial end of the envelope 12, adjoins the transition portion 24. The connecting portion 26 has an angle of inclination a, and the diameter of the envelope 12 at the outer end of the connecting portion 26 is larger than the initial diameter DA. It must also be noted that the total length of the envelope 12 increases during the shrinking process since half of the reduction of the diameter of the envelope 12 results in an increased wall thickness and the other half in an increased length.

In modern shrinking methods, the end diameter DE is adapted to the respective diameter of the component 16. It is however remarkable that changes in the end diameter DE lead only to a negligible degree to changes in the diameter of the connecting portion 26 and in the angle of inclination $\alpha$. It was found in tests that in case of a shrinking, for example from an initial diameter of 158.4 mm, to a set diameter of 152.8 mm and of an individual adaptation of the end diameter DE by ±1 mm in relation to the set diameter, an insignificant change in the diameter of the connecting portion in the range of ±0.1 mm could be observed. The length L by which the envelope projects beyond the shrinking tool 22 in the initial state varied here between 15 and 24 mm.

Figure 2:
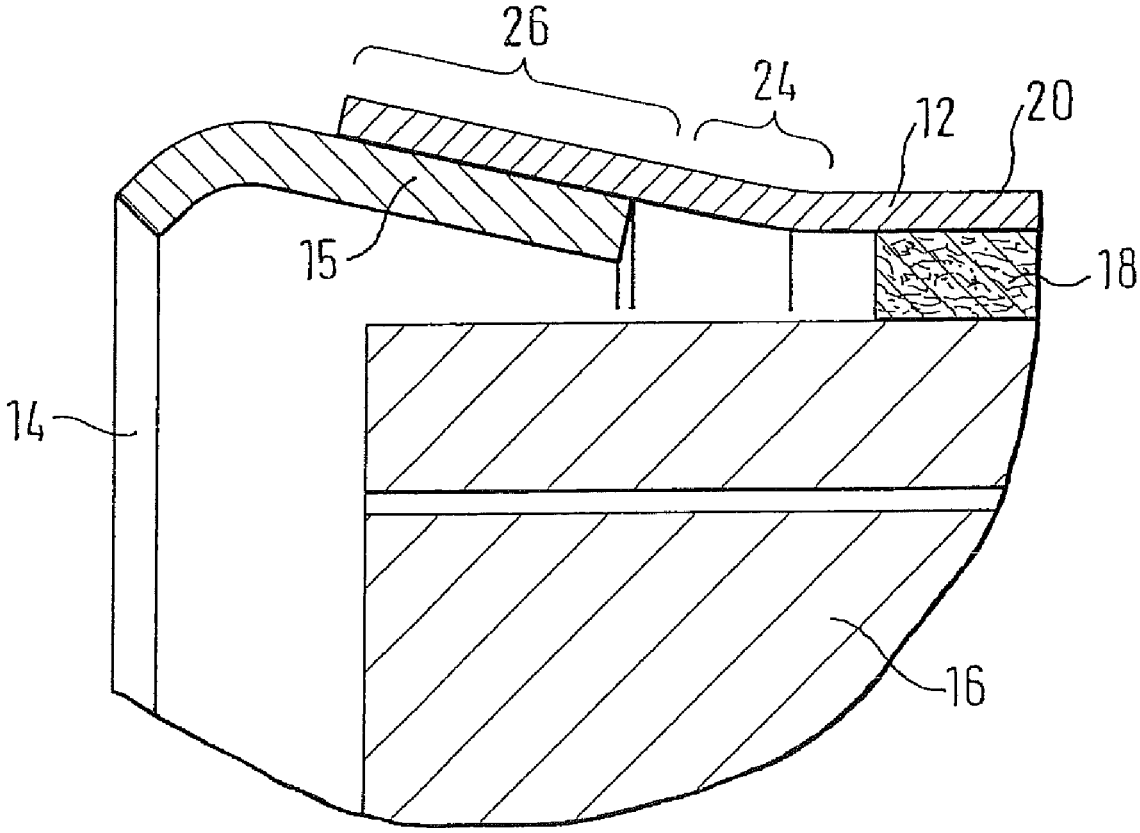
FIG. 2 shows the detail II of FIG. 1 on an enlarged scale.

Since the diameter and the angle of the connecting portion 26 always remain almost constant despite changes in the end diameter DE, it is possible to apply a standard coupling part 14 to each individually shrunk envelope 12. As can be seen in FIGS. 1 and 2, this standard coupling part 14 may have, for example, a conically extending coupling portion 15 that is inserted into the connecting portion 26. The envelope 12 and the coupling part 14 can then be connected, for example by being welded or soldered to each other.

A further advantage, which occurs if only part of the length of the envelope 12 is shrunk, consists in that the connecting portion 26 is widened in comparison with the initial diameter so that the coupling part 14 can be inserted into the space between the component 16 and the envelope 12. As can be clearly seen in FIGS. 1 and 2, the coupling part 14 overlaps the component 16. This results in a housing, which is particularly compact in the axial direction. The fact that the component 16 is freely received within the housing at its axial ends rather than clamped over its entire length does not impair the clamping between the envelope 12 and the component 16.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A housing for a component of an exhaust system, in particular for an exhaust gas purification device comprising:
- an envelope comprising a shrunk clamping portion for a component;
- a transition portion adjoining the shrunk clamping portion in an axial direction; and
- a connecting portion adjoining the transition portion in the axial direction wherein a diameter of the connecting portion is larger than a diameter of the shrunk clamping portion.

2. The housing according to claim 1, wherein the connecting portion has a shape of a portion of a cone.

3. The housing according to claim 1, wherein the connecting portion is part of a hyperboloid.

4. The housing according to claim 1, wherein the component is received within the housing and wherein the envelope terminates approximately flush with the component in the axial direction.

5. The housing according to claim 1, including a coupling part that is connected to the envelope, the coupling part having an obliquely extending coupling portion inserted into or slipped on the connecting portion for a firm connection to the envelope.

6. The housing according to claim 5, wherein the coupling part is welded, soldered or bonded to the housing.

7. The housing according to claim 1, wherein the component is a ceramic substrate which is surrounded by a support mat.

8. The housing according to claim 1, wherein the housing comprises a clamping portion having an initial diameter and axial ends projecting beyond the clamping portion, and wherein the clamping portion is reduced to an end diameter less than the initial diameter to form the shrunk clamping portion and with the axial ends each comprising the transition portion and connecting portion.

9. The housing according to claim 8, wherein the connecting portion is defined by a diameter that is greater than the end diameter of the clamping portion.

10. The housing according to claim 6, wherein each transition portion transitions from the shrunk clamping portion to the connecting portion, and wherein the transition portion is defined by an increasing diameter relative to the end diameter of the shrunk clamping portion, and wherein the connecting portion is defined by an increasing diameter relative to the transition portion.

11. The method according to claim 8 including a coupling portion connected to each connecting portion such that the coupling portion and connection portion are overlapping with each other.

12. A method of producing a housing for a component of an exhaust system comprising the following steps:
- (a) providing a tubular envelope;
- (b) inserting a component into the tubular envelope;
- (c) shrinking the tubular envelope in a clamping portion which terminates spaced apart from axial ends of the tubular envelope as viewed in an axial direction, whereas the axial ends of the envelope are not acted upon.

13. The method according to claim 12, including slipping a coupling part on, or inserting the coupling part into, the tubular envelope without further working steps for influencing a diameter of the axial ends being carried out.

14. The method according to claim 12, wherein the axial ends of the tubular portion project beyond the clamping portion to distal edges, and wherein the tubular portion has an initial diameter at the clamping portion prior to step c), and wherein step c) includes shrinking the clamping portion to an end diameter that is less than the initial diameter and such that a diameter at the distal edges of the axle ends is greater than the initial diameter.

15. The method according to claim 14, including forming the axial ends to have a transition portion transitioning from the clamping portion to a connecting portion that terminates at the distal edges, and including defining the transition portion with an increasing diameter relative to the end diameter and defining the connecting portion with an increasing diameter relative to the transition portion.

16. The method according to claim 15 including attaching a coupling portion to each connecting portion of the axial ends such that the coupling portion and connecting portion are overlapping with each other.

* * * * *